US006851182B2

(12) United States Patent
Okada

(10) Patent No.: US 6,851,182 B2
(45) Date of Patent: Feb. 8, 2005

(54) ADJUSTING JIG OF BUTTON ATTACHING APPARATUS

(75) Inventor: Tomoyuki Okada, Tokyo (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/722,905

(22) Filed: Nov. 25, 2003

(65) Prior Publication Data

US 2004/0103528 A1 Jun. 3, 2004

Related U.S. Application Data

(62) Division of application No. 10/133,252, filed on Apr. 25, 2002, now Pat. No. 6,766,569.

(30) Foreign Application Priority Data

Apr. 26, 2001 (JP) ..... 2001-129094

(51) Int. Cl.[7] ..... B23P 19/00
(52) U.S. Cl. ..... 29/798; 29/407.08
(58) Field of Search ..... 29/407.08, 407.09, 29/407.1, 464, 432, 432.1, 798, 513, 525.05, 465; 227/2, 15, 16, 17, 18, 142

(56) References Cited

U.S. PATENT DOCUMENTS

| | | | |
|---|---|---|---|
| 4,598,468 | A | 7/1986 | Yoshieda |
| 4,615,473 | A | 10/1986 | Taga |
| 4,694,984 | A | 9/1987 | Altwicker |
| 4,741,466 | A | 5/1988 | Birkhofer |
| 4,799,611 | A | 1/1989 | Taga |
| 4,907,481 | A | 3/1990 | Dvorak et al. |
| 5,060,839 | A | 10/1991 | Seki |
| 5,319,848 | A | 6/1994 | Schmidt et al. |
| 5,463,807 | A | 11/1995 | Hochhausl |
| 5,501,001 | A | 3/1996 | Kamps |
| 5,781,989 | A | 7/1998 | Schmidt |
| 6,378,192 | B1 | 4/2002 | Ohmi et al. |

FOREIGN PATENT DOCUMENTS

| | | |
|---|---|---|
| JP | 3-1447 | 12/1985 |
| JP | 62-41936 | 10/1986 |
| JP | 05-24242 | 4/1993 |
| JP | 5-55603 | 8/1993 |

*Primary Examiner*—David P. Bryant
(74) *Attorney, Agent, or Firm*—Michael S. Leonard; Everest Intellectual Property Law Group

(57) ABSTRACT

Jigs (52 to 57) are respectively set on upper and lower holders (21, 31) of a button attaching apparatus instead of upper and lower dies; relative position of the upper and the lower holders (21, 31) is adjusted while upper and lower springs (211, 317) are disabled; while the upper spring (211) is kept disabled, the lower spring (317) having stronger biasing force is enabled to adjust the lower spring; and the upper spring (211) is enabled to adjust the upper spring.

5 Claims, 6 Drawing Sheets

21
210
211
213
215
541
542
54
55
56
57
571
572
DR
DA
DC
TA
TB
TC
TS
TC'
S1
S2
T0
T1
T2
F0
F1
F2
52
521
31
301
305
310
314, 316
315
317

ADJUSTING JIG OF BUTTON ATTACHING APPARATUS

This is a divisional of application Ser. No. 10/133,252 filed Apr. 25, 2002 now U.S. Pat. No. 6,766,569, the entire disclosure of which is incorporated herein by reference.

BACKGROUND OF THE INVENTION

1. Field of the Invention

The present invention relates to an adjusting method of button attaching apparatus for attaching a button to a fabric and adjusting jig used in the adjusting method.

2. Description of Related Art

Conventionally, a button attaching apparatus for automating operation for attaching button etc. such as snap fastener has been utilized (see Japanese Utility Model Publication No. Hei 3-1447).

In such button attaching apparatus, one and the other of a pair of button components (button and backing member) are respectively attached to a pair of dies (first die and second die) sandwiching the fabric, the dies being pressed to caulk and engage the button and the backing member with each other sandwiching the fabric, thereby attaching the button to the fabric.

In the button attaching apparatus, a pair of holders capable of attaching and detaching the respective dies are provided so that a die corresponding to the button to be attached can be selectably used. A drive mechanism is provided on one or both of the respective holders to advance and retract the one or both of the dies in a direction for the dies to be moved toward and away from each other (along an advancement-retraction axis line), so that the respective dies are pressed or separated for attaching the button by caulking.

A cushion structure using spring etc. is provided to a part of the holder or the drive mechanism for absorbing fluctuation of the thickness of the fabric to a degree. In other words, even when the thick fabric is used, the die is pushed against, for instance, biasing force of a spring, so that generation of excessive pressing force between the dies can be prevented. Such cushion mechanism may be provided on either one of the dies or, alternatively, on both of the dies. When the cushion mechanism is provided on one of the dies, either of the advanceable holder and a stationary holder may be provided with the cushion mechanism. Further, various arrangements such as installing the cushion mechanism in the holder, supporting the holder in a cushioning manner against the drive mechanism and disposing the cushion mechanism on a part of the drive mechanism are possible for disposing the cushion mechanism.

Incidentally, when the button is attached by the button attaching apparatus, relatively low pressing force is required for the die in caulking claw portion. However, when rivet-bar type or eyelet type button is caulked, relatively high pressing force is necessary. In order to widely respond to the strong caulking force and weak caulking force, weak spring may be used for supporting one of the dies and strong spring may be used for supporting the other dies.

FIG. 4 shows a button attaching apparatus using the two, i.e. strong and weak springs.

The button attaching apparatus 10 has a metal, approximately box-shaped frame 11, the frame 11 having a recessed work portion 12 at a front side thereof. An upper holder 21 (first holder) for supporting an upper die 20 (first die) is located on the upper side of the work portion 12 and a lower holder 31 (second holder) for supporting a lower die 30 (second die) is located on the lower side thereof.

The lower holder 31 is fixed to the frame 11. On the other hand, the upper holder 21 is vertically advanced and retracted by a drive mechanism 40 installed in the frame 11 for a predetermined stroke. The drive mechanism 40 has a motor 41 as a drive source, which pivotably moves a link mechanism 46 through an arm 42, a rod 43, a crank 44 and a rod 45, the pivot movement vertically moving the upper holder 21.

Accordingly, in the button attaching apparatus 10, the upper holder 21 and the lower holder 31 are moved toward and away from each other by driving the drive mechanism 40, so that upper die 20 and the lower die 30 supported by the respective holders are separated and pressed to caulk the button and the backing member respectively held by the dies.

In the button attaching apparatus 10, the upper holder 21 and the drive mechanism 40 for advancing and retracting the upper holder constitute a first side portion and the lower holder 31 disposed on the frame 11 in a fixed manner constitutes a second side portion. An upper cushion mechanism 22 (a first cushion and a first cushion adjuster) are provided on the upper holder 21 included in the first side portion and a lower cushion mechanism 32 (a second cushion and a second cushion adjuster) are provided on the lower holder as the second side portion.

FIG. 5 shows an upper holder 21.

The upper holder 21 has a cylindrical case 210, the case 210 having a hollow section extending from the lower side of the figure to the upper side thereof, the hollow section accommodating a large number of coned disc springs 211 (first cushion), and an end member 212 is disposed on a free end of the coned disc spring 211.

A sleeve 213 is accommodated around the opening of the hollow section of the case 210, and an upper die 20 is attached to the sleeve 213 to prevent detachment by a setscrew 214. The sleeve 213 is abutted to the end member 212 through an adjusting bolt 215 and receives biasing force toward lower side in the figure by the coned disc spring 211. The movement of the sleeve 213 toward the lower side of the figure is restricted by an engaging member 217 projecting into a side opening 216 of the case 210 at a predetermined position. Accordingly, the sleeve 213 can be moved against the biasing force of the coned disc spring 211 when receiving a force in the upper direction in the figure. The adjusting bolt 215 can be rotated to change projection thereof from the sleeve 213, so that initial load applied to the coned disc spring 211 can be increased and decreased, thereby adjusting the biasing force from the coned disc spring 211 to the sleeve 213 (first cushion adjuster).

FIG. 6 shows a lower holder 31.

The lower holder 31 has a cylindrical case 310, the case 310 integrally clamping and fixing a part of the frame 11 and a base 312 along the backside of the frame 11 by screwing a nut 313 to an external screw formed on the outer circumference thereof. A plurality of tie rods 314 are connected to the base 312. A support plate 315 is inserted to an end of the tie rods 314, where an adjusting nut 316 is screwed. A coil spring 317 (second cushion) is disposed coaxially with the case 310 between the support plate 315 and the case 310.

A support rod 301 and a sleeve 302 are coaxially disposed inside the case 310 in an overlapping manner. A flange 303 is formed at the halfway of the sleeve 302, the flange 303 being supported by an upper end (in the figure) of the coil spring 317 and being held while being pressed to the nut 313 by the biasing force in the upper direction in the figure from the coil spring 317. A lower end (in the figure) of the sleeve 302 extends to a central opening of the support plate 315. An internal thread is formed at a distal end of the sleeve 302. An adjusting bolt 305 is screwed to the internal thread. A rotation-stop lock nut 304 is screwed to the adjusting bolt 305. An upper end (in the figure) of the adjusting bolt 305 is abutted to the lower end (in the figure) of the support rod 301. A lower die 30 is attached to an upper end (in the figure) of the case 310. The rotation of the lower die 30 is restricted by a buried screw 311 screwed from a side of the case 310 but is capable of vertical movement in the figure relative to the case 310. An end of the lower die 30 is abutted to the support rod 301 to support the load applied thereto. Accordingly, when the lock nut 304 is loosened and the adjusting bolt 305 is rotated relative to the sleeve 302, the support rod 301 is elevated and lowered relative to the sleeve 302 or the frame 11, so that the position of the lower die 30 relative to the upper die 20 can be adjusted (die position adjuster).

When a force to the lower side of the figure is applied from the lower die 30, the load is transferred to the sleeve 302 through the support rod 301, the adjusting bolt 305 and the nut 304 to press the coil spring 317. When the load is more than a predetermined value, the lower die or the sleeve 302 are moved to the lower side in the figure. The initial load of the coil spring 317 can be increased and decreased by adjusting the position of the support plate 315 by rotating the adjusting nut 316, so that the biasing force applied from the coil spring 317 to the sleeve 302 can be adjusted (second cushion adjuster).

Incidentally, a guard 308 using a weak coil spring 309 is attached around the lower die 30 for preventing fall-off of the buttons etc. before the die touches the fabric.

In the above button attaching apparatus 10, the upper coned disc spring 211 is normally of relatively weak biasing force and the lower coil spring 317 is normally of relatively strong biasing force. Specifically, the weak biasing force of the upper coned disc spring 211 is set for a button capable of being attached with weak caulking force and the strong biasing force of the lower coil spring 317 is set for a button requiring strong caulking force. Accordingly, the coned disc spring 211 or the coil spring 317 is displaced in accordance with the difference in the thickness of each fabric using the same button attaching apparatus 10 either in a case requiring strong caulking force or in a case capable of displacement with a weak caulking force, thereby appropriately attaching the buttons in accordance with characteristics of the respective fabric.

For instance, when a button capable of being attached with a weak caulking force, the button etc. is held respectively on the upper die 20 and the lower die 30 and the upper die 20 and the lower die 30 are moved toward each other to sandwich the fabric disposed on the halfway thereof. At this time, since the caulking force is weak, the coil spring 317 of the lower holder of which biasing force is set strong is not compressed. On the other hand, the coned disc spring 211 of the upper holder 21 of which biasing force is set weak is appropriately compressed to be displaced in accordance with the fabric, thereby appropriately attaching the button.

For attaching a button requiring strong caulking force, the button etc. is held respectively on the upper die 20 and the lower die 30 and the upper die 20 and the lower die 30 are moved closer to sandwich the fabric disposed on the halfway thereof. At this time, a large-diameter upper die 20 (see dotted line in FIG. 5) is used in the upper holder 21 so that outer circumference 20A is abutted not to the sleeve 213 but to the case 210, so that the coned disc spring 211 of weak biasing force is not compressed, thereby allowing strong caulking force. Accordingly, the coil spring 317 of which biasing force is set strong is compressed in the lower holder 31, thereby conducting displacement in accordance with the fabric for appropriate button attaching.

Incidentally, in order to appropriately attach the button in the above-described button attaching apparatus 10, the biasing force of the coned disc spring 211 and the coil spring 317 has to be set at an appropriate value in the upper holder 21 and the lower holder 31.

Additionally, though the fluctuation in the thickness of the fabric can be appropriately dealt with by the above-described cushion mechanism, appropriate caulking force is influenced by the load required for plastic deformation of the button and the backing member and the rigidity of the frame etc. Since the caulking force required for, for instance, snap fastener, amounts to approximately 1000 to 8000N, not only the flexure of the spring but also the flexure of the frame etc. has to be taken into consideration in attaching the button.

Accordingly, the setting of the button attaching apparatus has to be adjusted at least on the initial stage of installation for each button attaching apparatus and the buttons to be attached.

At present, in order to appropriately attach the buttons, 1) adjustment of relative position (bottom dead center position of advancing and retracting crank mechanism etc.) when the upper die and the lower die are brought the closest, and 2) adjustment of cushion mechanism in accordance with the fabric (adjustment of initial load of the coned disc spring 211 by the adjusting bolt 215 and adjustment of initial load by the coil spring 317 by the adjusting nut 316) are considered necessary.

Conventionally, such adjustment is conducted by actually conducting repeated button attaching while the buttons and the backing members are put into the dies and checking finished condition resulted therefrom.

However, in the above method, repeated setting processes and finish checks are required for adjusting the above die position and respective initial load. Especially, since the buttons are actually attached by putting the buttons and backing members into the dies, totally great amount of work is necessary. Further, since the reference thickness of fabric has to be administered for adjusting the cushion mechanism, handling thereof becomes troublesome. Furthermore, since spring constant of the cushion mechanism and rigidity of the mechanical portion of the frame etc. are greatly deviated, reference value setting is difficult, requiring much time and skill for adjustment and making appropriate adjustment difficult.

A primary object of the present invention is to provide an adjusting method and adjusting jig capable of easily and rapidly conducting adjustment required for a button attaching apparatus.

SUMMARY OF THE INVENTION

An adjusting method according to an aspect of the present invention is for a button attaching apparatus which has: a first die capable of receiving one of a pair of button components and located on a predetermined advancement-retraction axis line; a second die capable of receiving the other of the pair of button components and located on the advancement-retraction axis line opposing the first die; a first side portion having a first holder supporting the first die in an attachable and detachable manner and in a manner movable along the advancement-retraction axis line; a second side portion having a second holder supporting the second die in an attachable and detachable manner; a drive mechanism provided at least one of the first side portion or the second side portion for moving the first holder or the second holder toward and away from each other along the predetermined advancement-retraction axis line; a first cushion provided on the first side portion for biasing the first die toward the second die; and a first cushion adjuster for adjusting the biasing force of the first cushion, the method including the steps of: providing a first adjusting jig and a second adjusting jig, at least one of the first adjusting jig and the second adjusting jig being attached with a force gauge; setting the first adjusting jig and the second adjusting jig to the first holder and the second holder instead of the first die and the second die; adjusting a relative position of the first holder and the second holder so that a force measured by the force gauge becomes a predetermined value by mutually pressing the first adjusting jig and the second adjusting jig by bringing the first holder and the second holder closest with each other while the first cushion is disabled; and adjusting the first cushion adjuster so that the force measured by the force gauge becomes a predetermined value by mutually pressing the first adjusting jig and the second adjusting jig by bringing the first holder and the second holder closest with each other while the first cushion is enabled.

According to the above aspect of the present invention, adjustment of the relative position of the first holder and the second holder and adjustment of the first cushion can be conducted by measuring the force applied between the first holder and the second holder, so that reliability and speed of the adjustment can be greatly improved as compared to the conventional adjustment based on repeated trial.

An adjusting method according to another aspect of the present invention is for adjusting a button attaching apparatus which has: a first die capable of receiving one of a pair of button components and located on a predetermined advancement-retraction axis line; a second die capable of receiving the other of the pair of button components and located on the advancement-retraction axis line opposing the first die; a first side portion having a first holder supporting the first die in an attachable and detachable manner and in a manner movable along the advancement-retraction axis line; a second side portion having a second holder supporting the second die in an attachable and detachable manner; a drive mechanism provided at least one of the first side portion or the second side portion for moving the first holder or the second holder toward and away from each other along the predetermined advancement-retraction axis line; a first cushion provided on the first side portion for biasing the first die toward the second die; a first cushion adjuster for adjusting the biasing force of the first cushion; a second cushion being stronger than the first cushion and being provided on the second side portion for biasing the second die toward the first die; and a second cushion adjuster for adjusting the biasing force of the second cushion, the method comprising the steps of: providing a first adjusting jig and a second adjusting jig, at least one of the first adjusting jig and the second adjusting jig being attached with a force gauge; setting the first adjusting jig and the second adjusting jig to the first holder and the second holder instead of the first die and the second die; adjusting a relative position of the first holder and the second holder so that a force measured by the force gauge becomes a predetermined value by mutually pressing the first adjusting jig and the second adjusting jig by bringing the first holder and the second holder closest with each other while both of the first cushion and the second cushion are disabled; adjusting the second cushion adjuster so that the force measured by the force gauge becomes a predetermined value by mutually pressing the first adjusting jig and the second adjusting jig by bringing the first holder and the second holder closest with each other while the second cushion is enabled and the first cushion is disabled; and adjusting the first cushion adjuster so that the force measured by the force gauge becomes a predetermined value by mutually pressing the first adjusting jig and the second adjusting jig by bringing the first holder and the second holder closest with each other while both of the first cushion and the second cushion are enabled.

According to the above aspect of the present invention, adjustment of the relative position of the first holder and the second holder, adjustment of the first cushion and adjustment of the second cushion can be conducted by measuring the force applied between the first holder and the second holder, so that reliability and speed of the adjustment can be greatly improved as compared to the conventional adjustment based on repeated trial.

Especially, though great trouble accompanied in the conventional arrangement when both of the first cushion and the second cushion are provided, the adjustment can be conducted using the same force gauge and the same operations in the present aspect of the present invention.

Incidentally, in the adjusting method of the present invention, the advancement-retraction axis line is not restricted to extend in vertical direction as in the conventional arrangement but may extend in the horizontal direction (right and left). Any drive mechanism can be used as long as the first die and the second die can be moved toward and away with each other, where either one of the first die and the second die may be moved as in the conventional arrangement or, alternatively, both of the first die and the second die may be driven. The first holder on the first side portion may be driven by the drive mechanism or may be provided on the frame in a fixed manner. The second holder of the second side portion may be driven by the drive mechanism or may be provided on the frame in a fixed manner.

The first cushion can be provided on any position of the first side portion. For instance, the first cushion may be provided in the first holder of the first side portion, may be provided in the drive mechanism when the first holder is advanced and retracted, and may be provided between the first holder and the frame when the first holder is not advanced and retracted.

The second cushion may be provided at any position of the second side portion. For instance, the second cushion may be provided in the second holder, may be provided in the drive mechanism when the second holder is advanced and retracted, and may be provided between the second holder and the frame when the second holder is not advanced and retracted.

Further, the application of the present invention is not restricted to the arrangement having both of the first cushion and the second cushion, but may be applied to an arrangement having the cushion only one side.

In the present invention, the measurement of the force by the force gauge can be achieved with use of existing signal processor etc.

In the present invention, disabling the first cushion or the second cushion refers to a condition where the biasing force (resilient repulsive force) of the first cushion or the second cushion is not generated, which can specifically achieved by fixing the portions connected by the first cushion or the second cushion. For instance, the first cushion or the second cushion is deformed to the compression limit thereof by, for instance, tightening the adjusting bolt etc. to the maximum, further deformation is impossible to fix the movement thereof, thereby disabling the cushion. Alternatively, an independent connector may be provided to connect the portions connected by the first cushion or the second cushion to fix the first cushion or the second cushion for disabling the cushion.

In the adjusting method of the present invention, an adjusting jig which is abutted to the first holder so that movement thereof is restricted in the advancement-retraction axis line direction may preferably be used as the first adjusting jig or an adjusting jig which is abutted to the second holder so that movement thereof is restricted in the advancement-retraction axis line direction may preferably be used as the second adjusting jig for disabling the biasing force of the first cushion or the second cushion.

For instance, an adjusting jig having greater diameter than that of the first die or the second die may be used to abut to a stationary portion of the case etc. of the first holder or the second holder, so that the movement of the jig can be easily restricted in the advancement-retraction axis line direction.

According to the present invention, though dedicated jig is necessary, since operation for tightening the spring to the limit thereof etc. is not necessary, rapid operation can be conducted with a simple structure.

In the adjusting method of the present invention, an adjusting jig having a thin portion on a part thereof may preferably be used as either one of the first adjusting jig or the second adjusting jig, and a strain gauge or a piezoelectric gauge may preferably be attached to the thin portion.

The thin portion can magnify the distortion caused by the force applied between the first holder and the second holder, which can be securely and accurately detected by a sensor such as a strain gauge or a piezoelectric gauge.

In the present invention, the first and the second cushion may be a mechanical spring such as coil spring, coned disc spring and plate spring, or may be air cylinder, hydraulic cylinder, air damper or a hydraulic damper. However, considering simpleness of the structure, facilitation of adjustment and durability, mechanical spring may preferably be used.

An adjusting jig according to still another aspect of the present invention is used for adjusting a button attaching apparatus which has: a first die capable of receiving one of a pair of button components and located on a predetermined advancement-retraction axis line; a second die capable of receiving the other of the pair of button components and located on the advancement-retraction axis line opposing the first die; a first side portion having a first holder supporting the first die in an attachable and detachable manner and in a manner movable along the advancement-retraction axis line; a second side portion having a second holder supporting the second die in an attachable and detachable manner; a drive mechanism provided at least one of the first side portion or the second side portion for moving the first holder or the second holder toward and away from each other along the predetermined advancement-retraction axis line; a first cushion provided on the first side portion for biasing the first die toward the second die; and a first cushion adjuster for adjusting the biasing force of the first cushion, in which a position adjustment thickness (T0) required for adjusting relative position of the first holder and the second holder and a first adjustment thickness (T1) required for adjusting the biasing force of the first cushion are selectable.

An adjusting jig according to further aspect of the present invention is used for adjusting a button attaching apparatus which has: a first die capable of receiving one of a pair of button components and located on a predetermined advancement-retraction axis line; a second die capable of receiving the other of the pair of button components and located on the advancement-retraction axis line opposing the first die; a first side portion having a first holder supporting the first die in an attachable and detachable manner and in a manner movable along the advancement-retraction axis line; a second side portion having a second holder supporting the second die in an attachable and detachable manner; a drive mechanism provided at least one of the first side portion or the second side portion for moving the first holder or the second holder toward and away from each other along the predetermined advancement-retraction axis line; a first cushion provided on the first side portion for biasing the first die toward the second die; a first cushion adjuster for adjusting the biasing force of the first cushion; a second cushion being stronger than the first cushion and being provided on the second side portion for biasing the second die toward the first die; and a second cushion adjuster for adjusting the biasing force of the second cushion, in which a position adjustment thickness (T0) required for adjusting relative position of the first holder and the second holder, a first adjustment thickness (T1) required for adjusting the biasing force of the first cushion, and a second adjustment thickness (T2) required for adjusting the biasing force of the second cushion are selectable.

Such jig may be a plurality of jigs of predetermined thickness which is exchanged in use, or may be an assembly jig including a plurality of blocks to be superposed to achieve the predetermined thickness.

With the use of the jig, the above adjusting method including adjustment of the position of the first holder and the second holder, adjustment of the first cushion and adjustment of the second cushion can be securely and rapidly conducted.

The adjusting jig of the present invention may preferably have a base member having a shaft capable of being attached to the first holder or the second holder and a flange formed on an end of the shaft; and an additional member formed in a ring capable of being inserted to the shaft and superposed on the flange may preferably be provided, in which the position adjustment thickness (T0) and the first adjustment thickness (T1) can be formed only with the flange or the superposition of the flange and the additional member.

The adjusting jig of the present invention may preferably have a base member having a shaft capable of being attached to the first holder or the second holder and a flange formed on an end of the shaft; and an additional member formed in a ring capable of being inserted to the shaft and superposed on the flange, in which the position adjustment thickness (T0), the first adjustment thickness (T1) and the first adjustment thickness (T2) can be formed only with the flange or the superposition of the flange and the additional member.

According to the above arrangement, the assembly-type jig using ring-shaped additional member is used so that attachment and detachment can be facilitated and the components can be stably assembled, thereby enhancing usability thereof.

In the adjusting jig of the present invention, any of the additional members may preferably be abutted to the first holder or the second holder so that movement thereof is restricted in the direction of the advancement-retraction axis line in order to disable the biasing force of the first cushion or the second cushion, and the other of the additional members may preferably not interfere with the first holder or the second holder for enabling the biasing force of the first cushion or the second cushion.

According to the above arrangement, either one of the cushion can be disabled in the above adjusting method using the exchangeable additional member of the adjusting jig, so that the operation of the above adjusting method can be further simplified.

DETAILED DESCRIPTION OF PREFERRED EMBODIMENT(S)

An embodiment of the present invention will be described below with reference to attached drawings.

Figure 4:
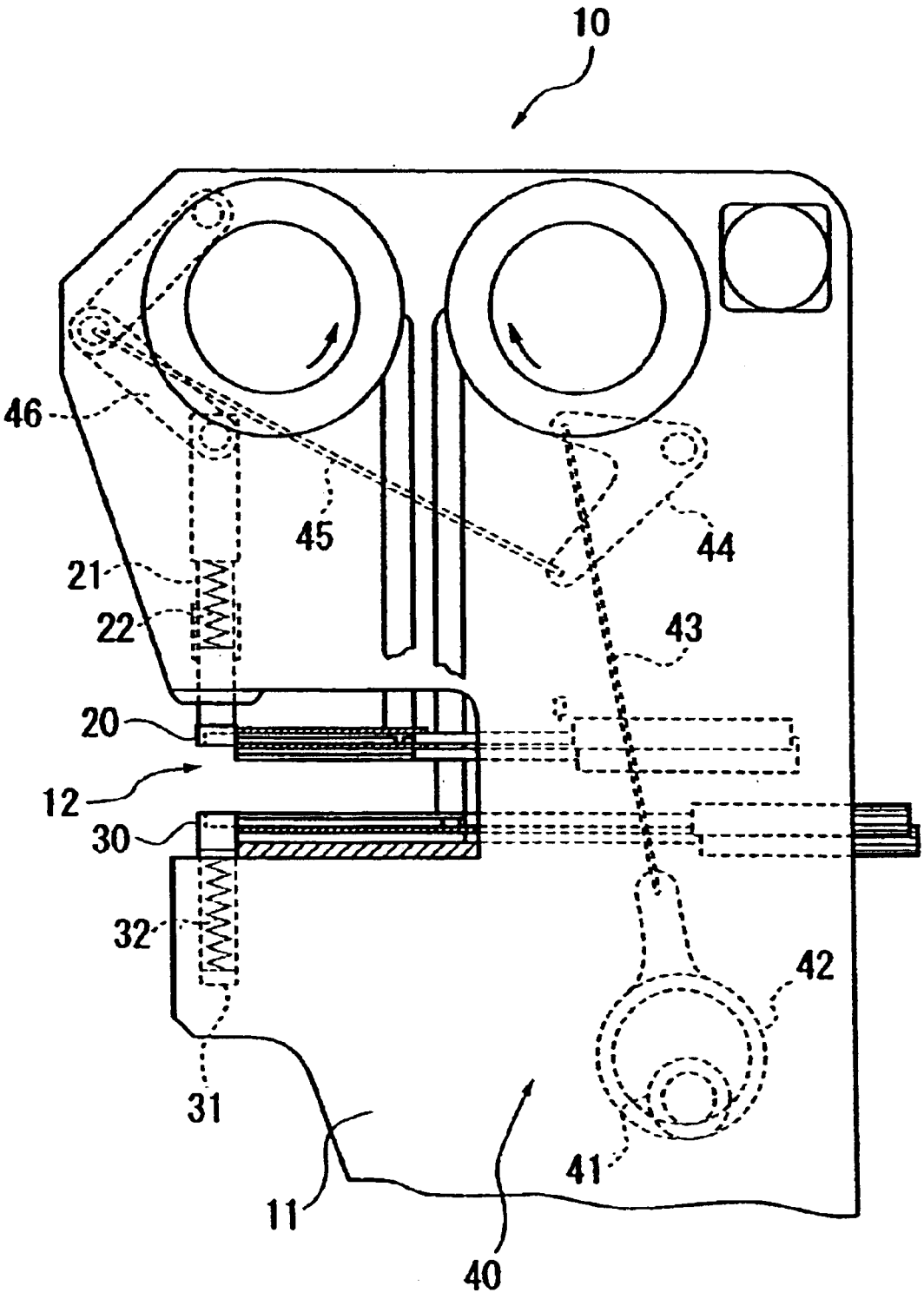
FIG. 4 PRIOR ART
FIG. 4 is a schematic illustration showing a driving mechanism of a button attaching apparatus in which the present invention is applied.
Figure 5:
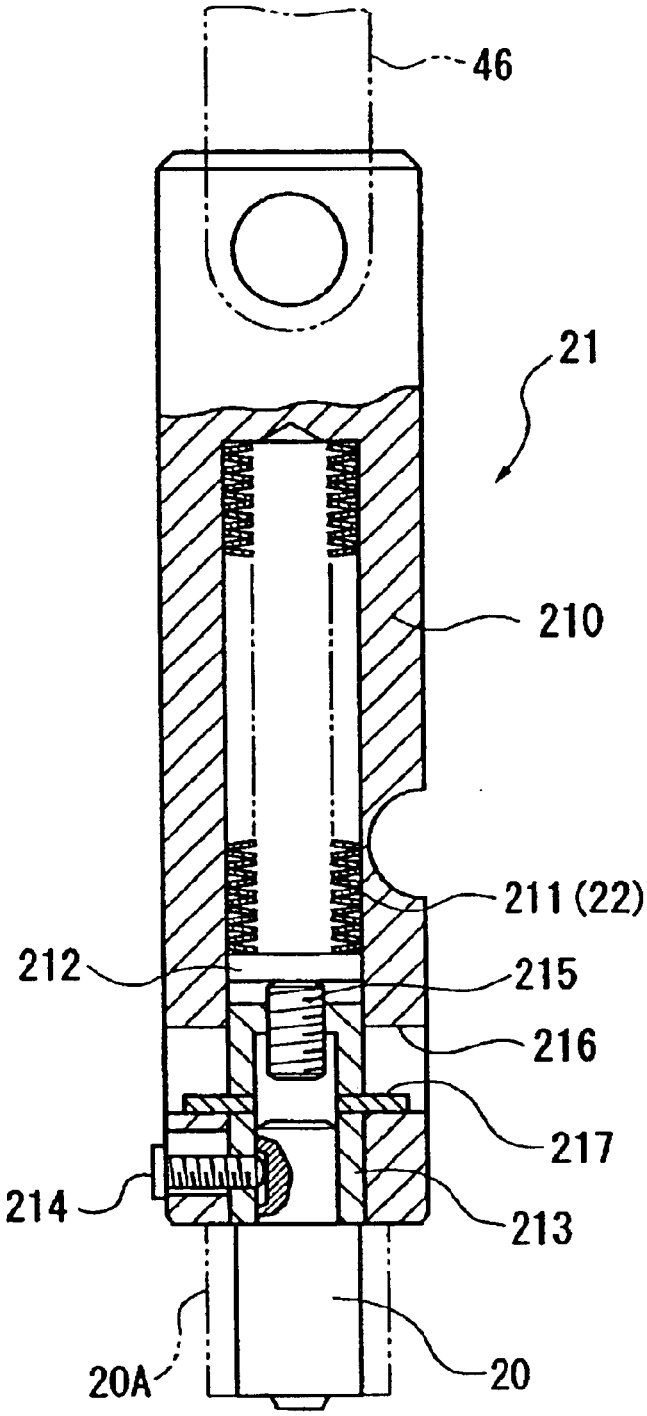
FIG. 5 PRIOR ART
FIG. 5 is a cross section showing an upper holder of the button attaching apparatus.
Figure 6:
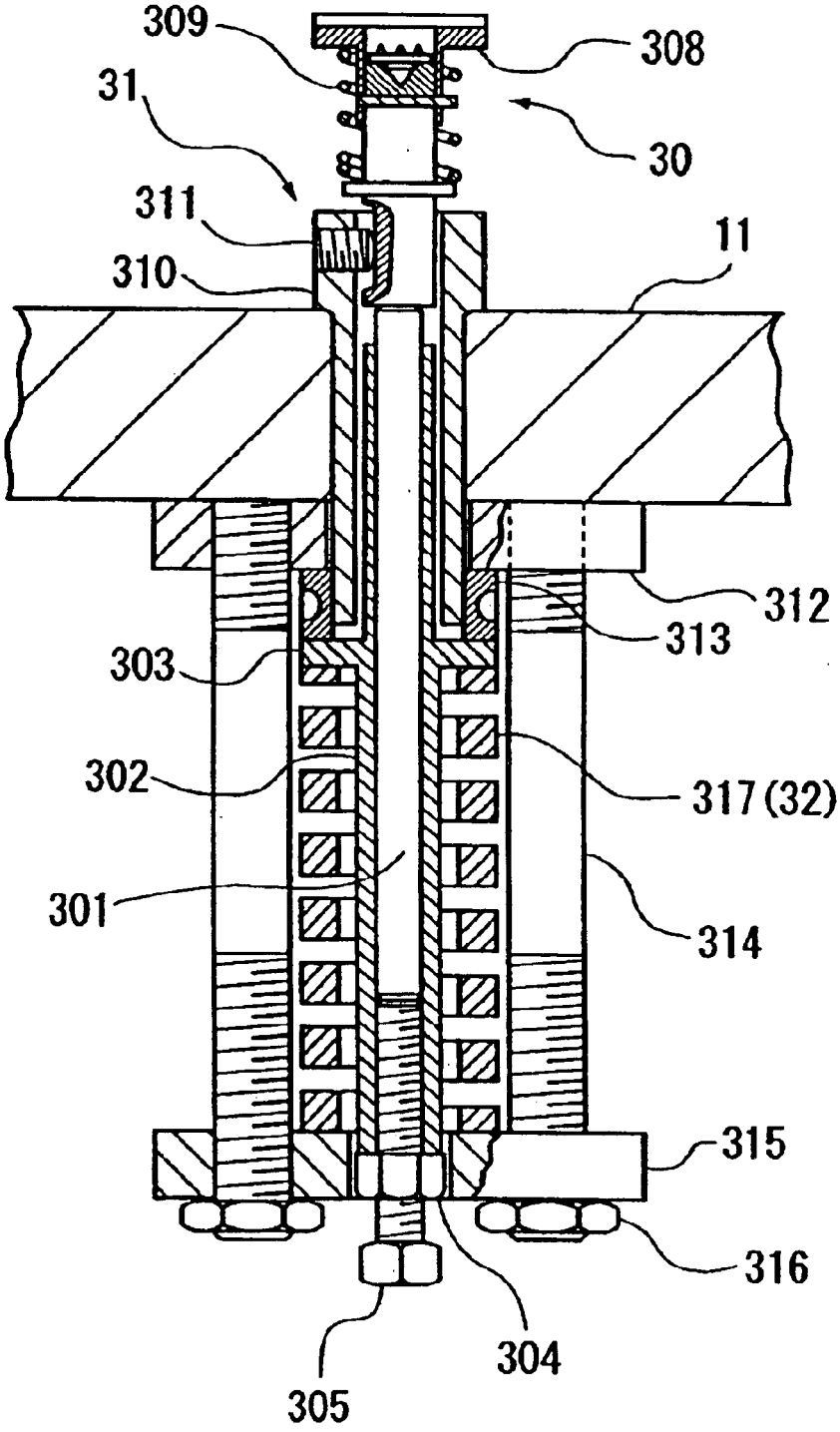
FIG. 6 PRIOR ART
FIG. 6 is a cross section showing a lower holder of the button attaching apparatus.

In the present embodiment, initial adjustment of the above-described button attaching apparatus 10 (see FIGS. 4, 5 and 6) is conducted using adjusting method and adjusting jig of the present invention.

Since the button attaching apparatus 10 is as described above, repeated explanation is omitted here and the adjusting jig and the adjusting method using the adjusting jig according to the present invention will be described below.

Figure 1:
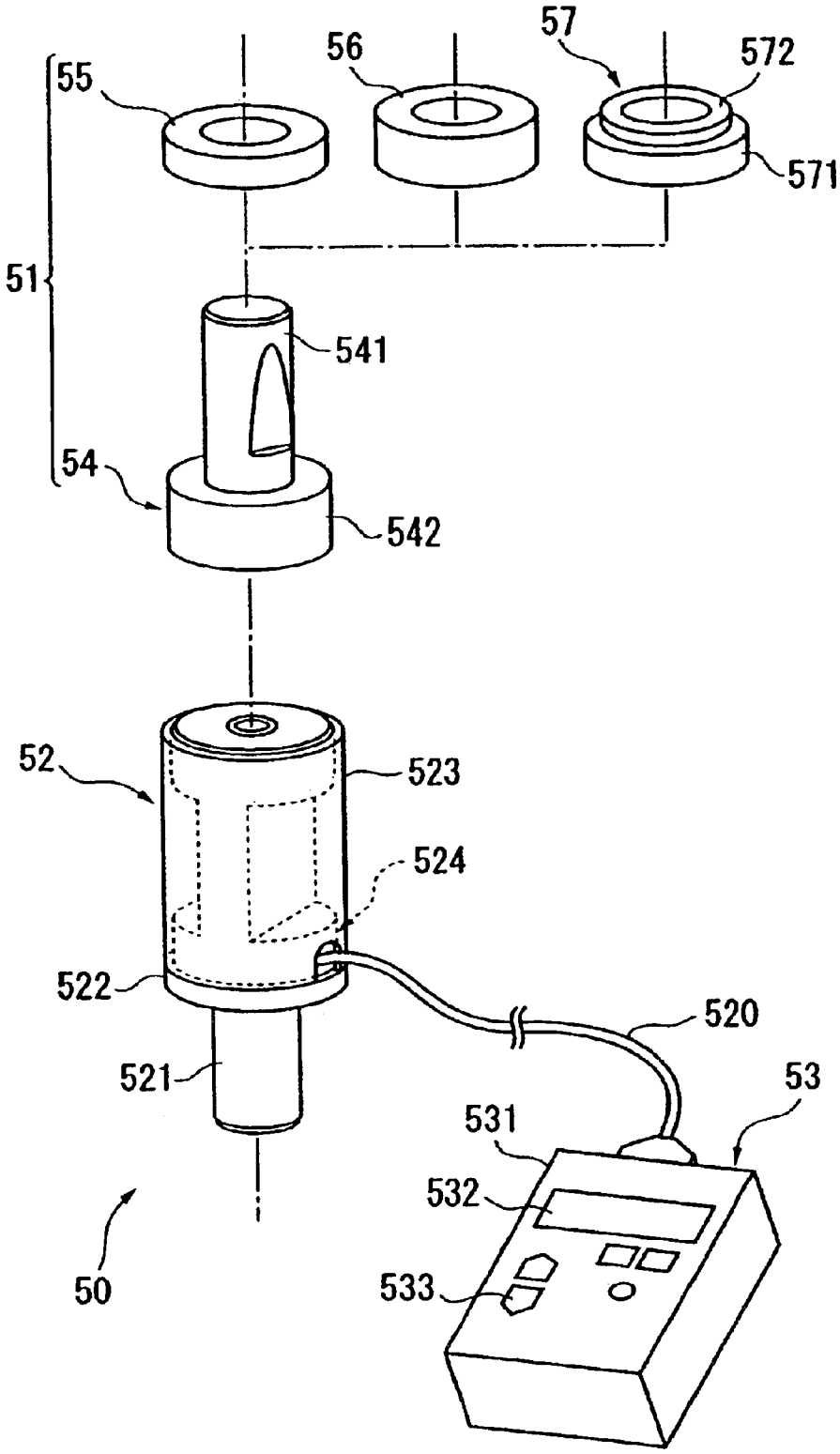
FIG. 1 is a perspective view showing an adjusting jig according to an embodiment of the present invention.

FIG. 1 shows a set of adjusting jig 50.

The adjusting jig 50 includes an upper jig set 54 used as a first adjusting jig, a pinch die 52 used as a second adjusting jig, and a data logger 53 for processing the signal from the pinch die 52.

In FIG. 1, the upper jig set 54 is composed of a single upper jig 54 as a base member and three washers (A washer 55, B washer 56 and C washer 57) as additional members.

Figures 3A, 3B, 3C:
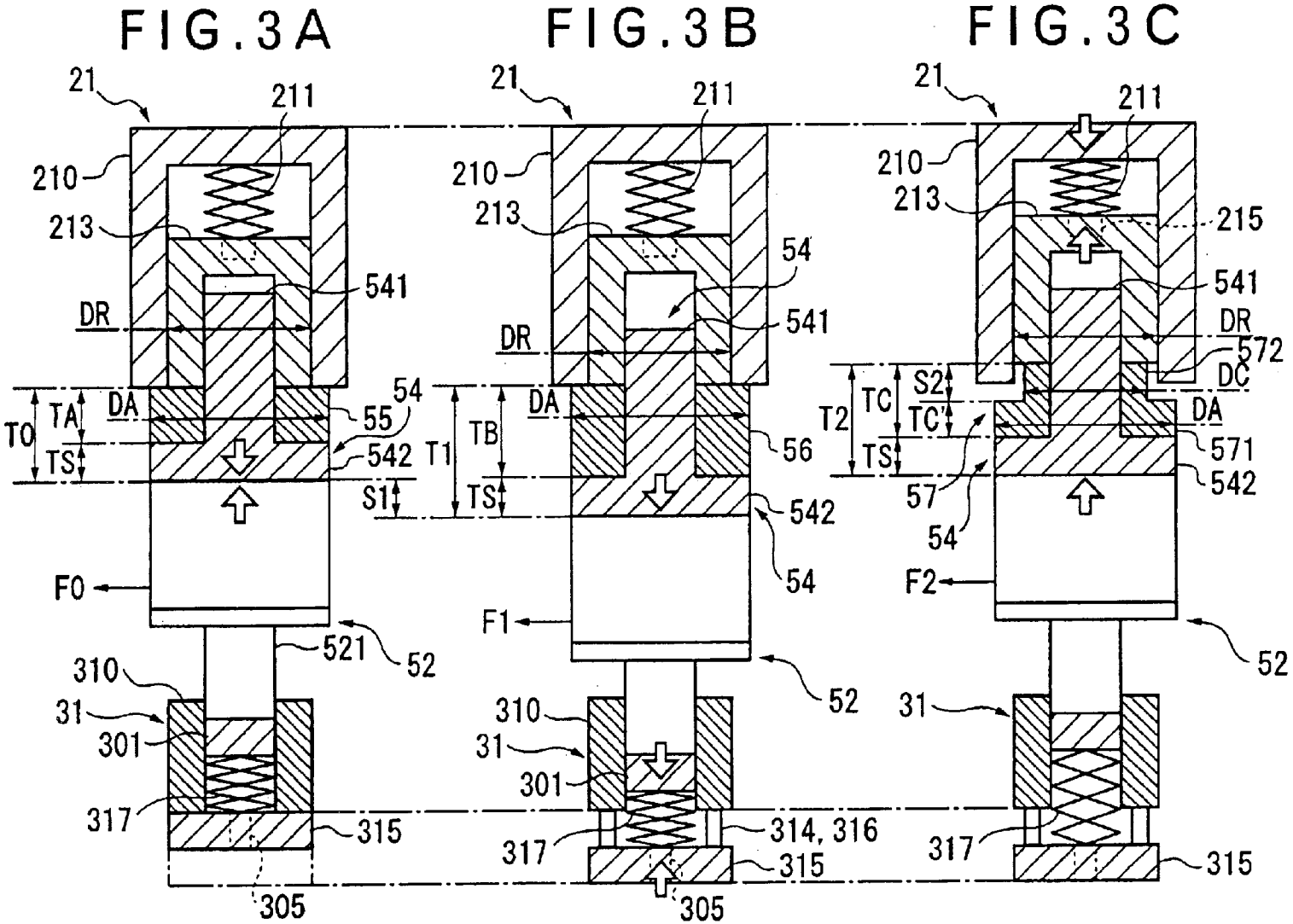
FIGS. 3(A) to 3(C) are illustrations showing respective steps of adjusting process.

As shown in FIGS. 3(A) to 3(C), the upper jig 54 has a columnar shaft 541 and a disc-shaped flange 542 formed at an end of the shaft 541. The shaft 541 is formed in a shape corresponding to the supported portion of the upper die 20 and can be supported by an upper holder 21. The disc of the flange 542 is of thickness TS and outer diameter DA, the outer diameter DA being greater than an outer diameter DR of the sleeve 213 of the upper holder 21.

The A washer 55 is formed in a ring and has thickness TA and outer diameter DA approximately the same as the upper jig 54. The A washer 55 is inserted to the shaft 541 of the upper jig 54 to be superposed on the flange 542, thereby forming a columnar block of outer diameter DA and thickness T0 (T0=TS+TA).

The B washer 56 is formed in a ring and has thickness TB (TB>TA) and outer diameter DA approximately the same as the upper jig 54. The B washer 56 is inserted to the shaft 541 of the upper jig 54 to be superposed on the flange 542, thereby forming a columnar block of outer diameter DA and thickness T1 (T1=TS+TB). The difference between the thickness of the A washer 55 and the thickness of the B washer 56 is S1=T1−T0=TB−TA. Incidentally, as described below, TB>TA setting is set by disabling the coil spring 317 in adjusting die position by tightening the coil spring 317 as the second cushion near the limit and enabling the coil spring 317 thereafter. The enabled coil spring 317 is longer than that in the disabled condition thereof. In adjustment, in order to compress the extended coil spring 317 to a degree, the B washer 56 of the thickness TB greater than the thickness TA of the A washer 55 is used. Accordingly, the degree S1 (=TB−TA) for the B washer 56 to be thickened relative to the A washer 55 may preferably be selected in accordance with the characteristics of the coil spring 317 (non-load length, spring constant etc.).

The C washer 57 is formed in a ring, and has a total thickness TC (TC>TA) and the same outer diameter DA approximately the same as the upper jig 54. A step is formed on one side of the C washer 57, which radially divides a flange 571 on the outside and a core 572 on the inside. The flange 571 has thickness TC' and the core 572 has thickness TC. Accordingly, the core 572 is projected from the flange 571 by the length corresponding to the step S2=TC−TC'. The flange 571 has the outer diameter DA and the core 572 has outer diameter DC (DC<DA). The C washer 57 is inserted to the shaft 541 of the upper jig 54 to be superposed on the flange 542, thereby forming a columnar block of outer diameter DC and thickness T2 (T2=TS+TC).

When the outer diameters DA and DC of the C washer 57 is compared to the outer diameter DR of the sleeve 213 of the upper holder 21, the relationship of: the outer diameter DA of the flange 571> the outer diameter DR of the sleeve 213> the outer diameter DC of the core 572 is established. Accordingly, when the C washer 57 is set on the upper holder 21 together with the upper jig 54, the core 572 abuts only to the sleeve 213 and does not abut to the case 210 on the outside thereof. On the other hand, the flange 571 abuts to the case 210. Accordingly, the C washer can press the sleeve 213 to the case 210 for the step S2.

Incidentally, the upper jig 54 and the respective washers 55 to 57 can be produced by carving metal material such as steel. However, molding of synthetic resin material etc. may be used as long as enough strength capable of sustaining the load used for adjustment of the present invention can be obtained.

Back to FIG. 1, the pinch die 52 has a columnar shaft 521 and a disc-shaped flange 522. A block 524 covered by a cylindrical cover 523 is formed on a side of the flange 522 opposite to the shaft 521.

As shown in FIGS. 3(A) to 3(C), the shaft 521 is formed in a shape corresponding to the supported portion of the lower die 30 and can be supported by the lower holder 31. The flange 522 is a disc of a predetermined thickness, which has, for instance the same outer diameter DA as the above-described upper jig 54.

Figure 2B:
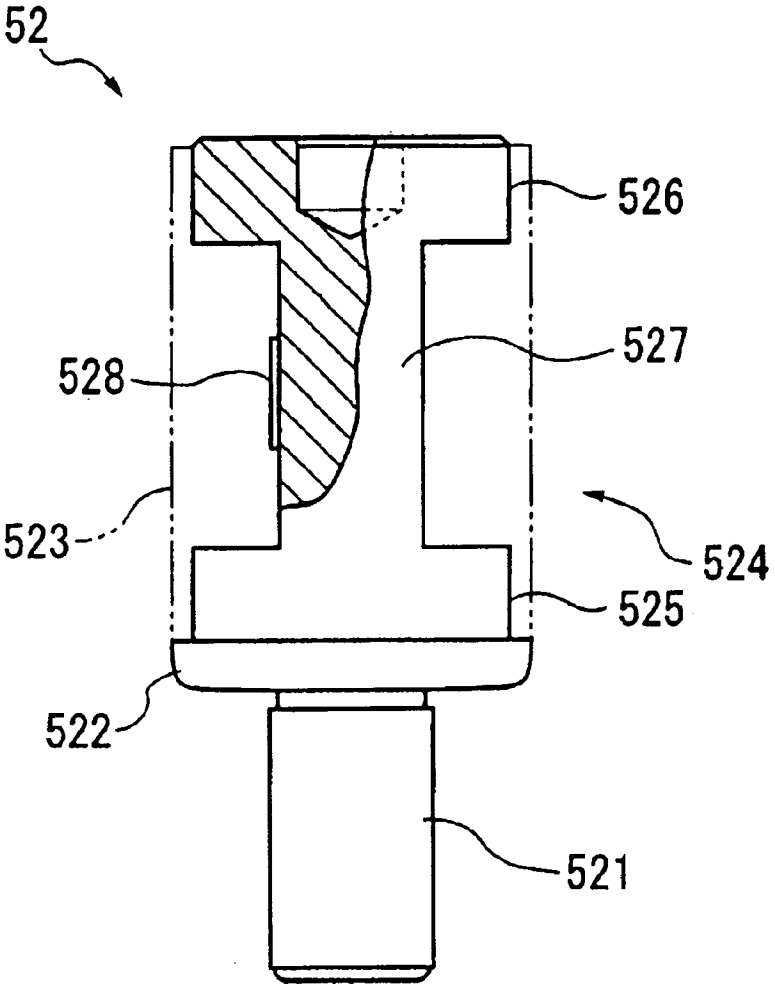
FIG. 2(A) and FIG. 2(B) are side elevational views showing a pinch die of the aforesaid embodiment.
Figure 2A:
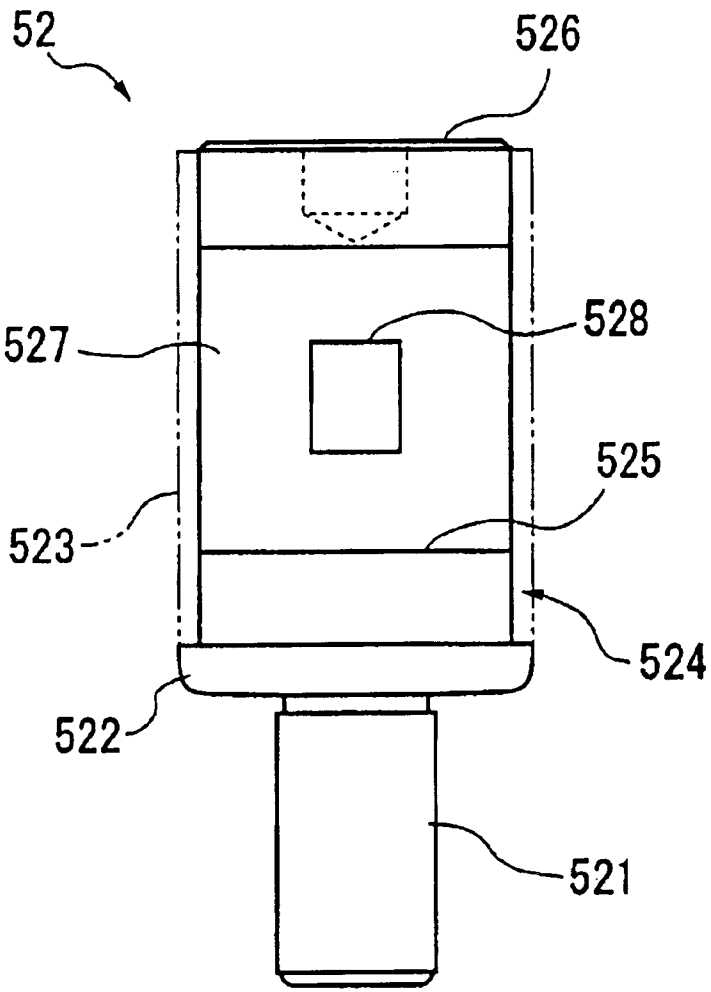

As shown in FIGS. 2(A) to 2(B), the block 524 is divided into a base block 525 continuous with to the flange 522, an end block 526 on a side opposite to the flange 522, and a middle block 527 formed between the base block 525 and the end block 526. The base block 525 is a disc of diameter slightly smaller than the flange 522 and the end block 526 is of approximately the same shape. On the other hand, the middle block 527 is formed in a thin plate (thin portion), which has thickness, for instance, smaller than the outer diameter of the shaft 521 (see FIG. 2(B)).

A force gauge 528 is provided on at least one surface of the middle block 527. The force gauge 528 may be existing strain gauge, piezoelectric gauge and other gauges capable of outputting physical quantity such as resistance and electric signal based on the distortion thereof in accordance with the load received by a surface of an object.

When, for instance, a compressive load is applied between the base block 525 and the end block 526, distortion in accordance with the applied load is eminently shown on the surface of the middle block 527 having small cross section, the distortion being securely detected by the force gauge 528.

The output signal of the force gauge 528 is drawn out to the outside by a cable 520 shown in FIG. 1, which is connected to the data logger 53 by a connector provided at the distal end thereof.

The connected portion of the force gauge 528 and the cable 520 is accommodated within the cylindrical cover 523 covering the outer circumference of the block 524 in order to protect against damage and pollution. The cover 523 is provided only on the outer circumference of the block 524 and the surface of the end block 526 is exposed to be directly pressed onto the upper jig 54 during adjustment process.

Incidentally, the respective blocks 525 to 527 forming the block 524 are formed of, for instance, continuous metal material such as steel. For production, a column corresponding to the block 524 may be carved from the metal material of which intermediate portion is carved from both sides to form the middle block 527. Alternatively, the sections from the block 524 to the flange 522 and the shaft 521 may be carved out of a continuous material. Further alternatively, the respective blocks may be produced by molding process using synthetic resin material as long as enough strength capable of sustaining load used for adjusting process of the present invention can be obtained and the load can be measured by the force gauge. Light weight and sufficient strength are required for the cover 523, which ordinarily be made by synthetic resin sheet.

Back to FIG. 1, the data logger 53 processes the output signal of the force gauge 528 of the pinch die 52 to display, record and process the load applied to the pinch die 52.

The data logger 53 has a metal or resin rectangular box case 531, a side thereof being provided with a connector (not shown) for the cable 520 from the pinch die 52. A display 532 such as liquid crystal display and an operation button 533 using membrane switch having superior dust-proof properties are disposed on the surface of the case 531.

A data processor (not shown) for processing the inputted signal to display as a load value on the display 532 is accommodated inside the case 531. Though any existing data processor which can at least calculate appropriate load value in accordance with the force gauge 528 can be used, the data processor may also preferably have a function for selecting displayed unit, calibrating function, self-check function and power control function etc. Further, the data processor may have a function for sequentially displaying guidance of steps in accordance with the adjusting method of the present invention and message etc. of the matter to be attended during measurement. Such messaging function can be incorporated based on existing computer technique.

Specific steps for adjustment using the above-described adjusting jig 50 will be described below.

Initially, the relative position of the upper holder 21 and the lower holder 31 is adjusted (die position adjustment).

In order to conduct the die position adjustment, the upper and the lower holders 21 and 31 of the button attaching apparatus 10 are separated to detach the upper die 20 from the upper holder 21, and the upper jig 54 combined with the A washer 55 is attached instead of the upper die 20. The A washer 55 abuts to the case 210 of the upper holder 21 and does not push the sleeve 213, so that the coned disc spring 211 of the upper holder 21 is disabled.

The lower die 30 is detached from the lower holder 31 and the pinch die 52 is attached instead of the lower die 30. The cable 520 of the pinch die 52 is connected to the data logger 53.

The support plate 315 is moved by tightening the adjusting nut 316 screwed to the tie rod 314 of the lower holder 31 to compress the coil spring 317 to deformation limit thereof. Accordingly, even when the load is applied to the pinch die 52 from the upper jig 54, the coil spring 317 is not deformed in accordance with the load, in other words, the coil spring 317 is disabled.

After completing the above preparation process, the upper and the lower holders 21 and 31 are slowly moved toward each other by manual operation so as not to apply shock on the button attaching apparatus 10, and the lower surface of the upper jig 54 and the upper surface of the pinch die 52 are pressed (condition shown in FIG. 3(A)).

Under the above condition, the load for attaching the button by the button attaching apparatus 10 is applied between the mutually pressing upper jig 54 and the pinch die 52. The load can be read from the indication of the data logger 53.

Subsequently, the button attaching apparatus 10 is operated so that the load value is taken when the upper holder 21 and the lower holder 31 are brought to the closest (bottom dead center position of the drive mechanism 40) and the upper holder 21 and the lower holder 31 are again separated to be returned to ordinary suspending condition. Then, the link adjustment of the drive mechanism 40 or the height adjustment etc. of the lower die 20 by the adjusting bolt 305 is conducted so that the load value comes close to a predetermined value. The measurement and adjustment are repeated for several times and the relative position of the upper holder 21 and the lower holder 31 are appropriately set when the measured load becomes a predetermined value.

Next, coil spring 317 of the lower holder 31 is adjusted (second cushion adjustment).

During the adjustment process, the upper and the lower holders 21 and 31 of the button attaching apparatus 10 are once separated and the upper jig 54 combined with the A washer 55 is detached from the upper holder 21 to attach again to the upper holder 21 after exchanging the A washer 55 for the B washer 56. Since the B washer 56 also abuts to the case 210 of the upper holder 21 and does not push the sleeve 213, the coned disc spring 211 of the upper holder 21 is kept disabled.

On the other hand, the adjusting nut 316 screwed to the tie rod 314 of the lower holder 31 is loosened to release the coil spring 317, so that the coil spring 317 is enabled to be deformed in accordance with the load when the load is applied from the upper jig 54 to the pinch die 52.

After the above preparation, the upper and the lower holders 21 and 31 of the button attaching apparatus 10 are moved toward each other so that the lower surface of the upper jig 54 and the upper surface of the pinch die 52 are pressed (condition shown in FIG. 3(B)).

In the above condition, the load for attaching the button by the button attaching apparatus 10 is applied between the mutually pressing upper jig 54 and the pinch die 52. At this time, since the coil spring 317 is enabled, the coil spring 317 displaces in accordance with the load of the pinch die 52 attached to the lower holder 31. The load value in this condition can be read from the display of the data logger 53.

Subsequently, the button attaching apparatus 10 is operated so that the load value is taken when the upper holder 21 and the lower holder 31 are brought to the closest (bottom dead center position of the drive mechanism 40) and the upper holder 21 and the lower holder 31 are again separated to be returned to ordinary suspending condition. Then, the cushion adjustment of the lower holder 31 is conducted so that the load value comes close to a predetermined value. Specifically, the adjusting nut 316 is rotated to elevate and lower the support plate 315 to adjust the length of the coil spring 317. The measurement and adjustment are repeated for several times and the spring force of the coil spring 317 of the lower holder 31 is appropriately set when the measured load becomes a predetermined value.

Next, the coned disc spring 211 of the upper holder 31 is adjusted (first cushion adjustment).

During the adjustment process, the upper and the lower holders 21 and 31 of the button attaching apparatus 10 are once separated and the upper jig 54 combined with the B washer 56 is detached from the upper holder 21 to attach again to the upper holder 21 after exchanging the B washer 56 for the C washer 57. Since the C washer 57 pushes the sleeve 213 without the core member being abutted to the case 210, the coned disc spring 211 of the upper holder 21 is enabled.

Incidentally, the coil spring 317 of the lower holder 31 is kept being released (being enabled). The arrangement is based on a knowledge that, since the coil spring 317 of the lower holder 31 is sufficiently strong relative to the coned disc spring 211 of the upper holder 21, no influence is caused even when the coil spring 317 is kept enabled as long as the weak load necessary for adjusting the coned disc spring 211 is applied.

After the above preparation is completed, the button attaching apparatus 10 is slowly operated by manual operation etc. to move the upper and the lower holders 21 and 31 toward each other and press the lower surface of the upper jig 54 and the upper surface of the pinch die 52 (condition shown in FIG. 3(C)).

In the condition, the load for attaching the button by the button attaching apparatus 10 is applied between the mutually pressing upper jig 54 and the pinch die 52. At this time, though both of the coned disc spring 211 and the coil spring 317 are enabled, since the coned disc spring 211 is weaker than the coil spring 317, the coil spring 317 is not contracted even when the caulking load is applied and the coned disc spring 211 is solely displaced in accordance with the applied load. The load value in this condition can be read from the display of the data logger 53.

Subsequently, the button attaching apparatus 10 is operated so that the load value is taken when the upper holder 21 and the lower holder 31 are brought to the closest (bottom dead center position of the drive mechanism 40) and the upper holder 21 and the lower holder 31 are again separated to be returned to ordinary suspending condition. Then, the cushion adjustment of the upper holder 21 is conducted so that the load value comes close to a predetermined value. Specifically, the adjusting bolt 215 between the coned disc spring 211 (end member 212) and the sleeve 213 is operated to adjust the length of the coned disc spring 211. The measurement and adjustment are repeated for several times and the spring force of the coned disc spring 211 of the upper holder 21 is appropriately set when the measured load becomes a predetermined value.

After completing the above adjustment, the upper and the lower holders 21 and 31 of the button attaching apparatus 10 are separated and the upper jig 54 and the pinch die 52 can be detached from the upper and the lower holders 21 and 31, to which the upper die 20 and the lower die 30 are attached again. Accordingly, the button attaching apparatus 10 is appropriately adjusted for use of button attaching.

According to the above-described present embodiment, following advantages can be obtained.

According to the adjusting method of the present embodiment, the drive mechanism 40 or the upper and the lower adjusting bolts 215 and 305 are operated while checking the load value displayed on the data logger 53 in order to adjust the relative position of the upper and the lower holders 21 and 31 and the upper and the lower spring force.

Accordingly, troublesome work of repeated setting and trial attaching can be eliminated and accuracy and speed of the adjusting work can be enhanced. Since it is only necessary to adjust the displayed load to a predetermined value, anyone, not restricted to skilled worker, can easily conduct adjusting work.

During adjustment, since the adjusting jig 50 of the present embodiment is used, works for adjusting relative position and upper and the lower spring force etc. can be easily and securely switched.

Especially, since the upper jig set 54 composed of a single upper jig 54 as a base member and three washers (A washer 55, B washer 56, C washer 57) as additional members is used, the necessary jig for respective adjustment processes can be rapidly exchanged. Further, since the upper jig 54 can be commonly used, material thereof can be reduced and usability thereof can be enhanced.

The outer diameter of the A washer 55, B washer 56, C washer 57 can be set to switch enablement and disablement of the coned disc spring 211 of the upper holder 21, thereby simplifying the operation.

On the other hand, since the thin-plate middle block 527 is formed as a thin portion on the pinch die 52 and the force gauge 528 is provided to the middle block 527, the influence of the load can be magnified as a distortion, thereby securely measuring the load applied to the pinch die 52.

Incidentally, the scope of the present invention is not restricted to the above-described embodiment but includes following modifications.

The upper jig set 54 is not restricted to the combination of the upper jig 54 as the base member and the respective washers 55 to 57 as the additional members. For instance, the combination of the upper jig 54 and the A washer 55 of the above-described embodiment may be arranged as a base die (thickness T0), and the additional washer (thickness T1−T2) may be combined to achieve the combination (thickness T1) of the upper jig 54 and the B washer 56 of the above-described embodiment. However, the above embodiment is preferable for securing the component strength since the thickness of the respective washer can be set great to a degree. In other words, when the additional washer becomes too thin, the washer is likely to be damaged.

The upper jig set 54 may not be prepared as a combined type but may be a plurality of dies having necessary thickness. For instance, a set of A die of the combination of the upper jig 54 and the A washer 55 of the above described embodiment (thickness T0), B die of the combination of the upper jig 54 and the B washer 56 (thickness T1), and C die of the combination of the upper jig 54 and the C washer 57 (thickness T2) may be sequentially and switchably used.

Though the coil spring 317 is compressed to the deformation limit in order to disable the coil spring 317 of the lower holder 31, the support rod 301 or the shaft 521 of the pinch die 52 may be fixed to the case 310 by tightening the setscrew from the side direction. Alternatively, the B washer etc. may be combined with the pinch die 52 to avoid the shaft 521 and the support rod 301 from being pressed, thereby disabling the coil spring 317. In the same manner, other method may be used in order to disable the coned disc spring 211 of the upper holder 21.

Though the upper die of the button attaching apparatus 10 to be adjusted is advanced and retracted in the above-described embodiment, the lower die may be advanced and retracted or both of the upper and the lower dies may be advanced and retracted. The cushion mechanism of the upper and the lower holders is not restricted to the coned disc spring, cushion using other spring and resilient member may be used. Further, the cushion mechanism is not restricted to mechanical spring but may be a cylinder using air pressure or hydraulic pressure. The structure of the respective cushion adjuster may be arranged in any manner, which can be appropriately selected in accordance with the type of the cushion to be adjusted.

The cushion mechanism is provided on both of the upper side and the lower side, and the relative position of the upper and the lower holder, the lower cushion mechanism and the upper cushion mechanism are sequentially adjusted in the above-described embodiment. However, the upper cushion mechanism may be adjusted after adjusting the relative position and the lower cushion mechanism may be adjusted thereafter. Adjustment on the upper cushion mechanism (coned disc spring 211) exerts little influence on the adjustment value of spring force in either case that the lower cushion mechanism (coil spring 317) is enabled or disabled.

When the button attaching apparatus has only one of the upper cushion mechanism and the lower cushion mechanism, only the upper cushion mechanism or the lower cushion mechanism may be adjusted after adjusting the relative position of the upper and the lower holders. In this case, the (either the upper or the lower) cushion mechanism may be disabled in adjusting the relative position of the upper and the lower holders and may be enabled again in adjusting the biasing force of the cushion mechanism. The disablement and enablement of the cushion mechanism may be conducted in a manner similar to the above-described embodiment.

Though the above-described embodiment is described with reference to the button attaching apparatus having vertical arrangement of the upper die 20 and the lower die 30 and the upper holder 21 and the lower holder 31, the present invention may be applied to a button attaching apparatus having horizontal or slanted advancement and retraction axis line.

Though the force gauge 528 is provided on one side of the middle block 527 in the above-described embodiment, the force gauge maybe provided on both sides of the middle block 527. In this arrangement, both outputs may be combined or average value may be calculated after individual measurement, thereby avoiding error caused by inclination etc. of the middle block 527.

As described above, the present invention can be applied for various button attaching apparatuses, where the jig can be selected as desired in accordance with configuration of minute component etc.

What is claimed is:

1. An adjusting jig used for adjusting a button attaching apparatus which has: a first die capable of receiving one of a pair of button components and located on a predetermined advancement-retraction axis line; a second die capable of receiving the other of the pair of button components and located on the advancement-retraction axis line opposing the first die; a first side portion having a first holder supporting the first die in an attachable and detachable manner and in a manner movable along the advancement-retraction axis line; a second side portion having a second holder supporting the second die in an attachable and detachable manner; a drive mechanism provided at least one of the first side portion or the second side portion for moving the first holder or the second holder toward and away from each other along the predetermined advancement-retraction axis line; a first cushion provided on the first side portion for biasing the first die toward the second die; and a first cushion adjuster for adjusting the biasing force of the first cushion, the adjusting jig comprising a thickness adjuster for changing a position adjustment thickness used in adjusting relative position of the first holder and the second holder and a first adjustment thickness used in adjusting the biasing force of the first cushion.

2. The adjusting jig of a button attaching apparatus according to claim 1, the thickness adjuster comprising:

a base member having a shaft capable of being attached to the first holder or the second holder and a flange formed on an end of the shaft; and an additional member formed in a ring capable of being inserted to the shaft and superposed on the flange, wherein the position adjustment thickness and the first adjustment thickness can be formed only with the flange or the superposition of the flange and the additional member.

3. An adjusting jig used for adjusting a button attaching apparatus which has: a first die capable of receiving one of a pair of button components and located on a predetermined advancement-retraction axis line; a second die capable of receiving the other of the pair of button components and located on the advancement-retraction axis line opposing the first die; a first side portion having a first holder supporting the first die in an attachable and detachable manner and in a manner movable along the advancement-retraction axis line; a second side portion having a second holder supporting the second die in an attachable and detachable manner; a drive mechanism provided at least one of the first side portion or the second side portion for moving the first holder or the second holder toward and away from each other along the predetermined advancement-retraction axis line; a first cushion provided on the first side portion for biasing the first die toward the second die; a first cushion adjuster for adjusting the biasing force of the first cushion; a second cushion being stronger than the first cushion and being provided on the second side portion for biasing the second die toward the first die; and a second cushion adjuster for adjusting the biasing force of the second cushion, the adjusting jig comprising a thickness adjuster for changing a position adjustment thickness used in adjusting relative position of the first holder and the second holder, a first adjustment thickness used in adjusting the biasing force of the first cushion, and a second adjustment thickness used in adjusting the biasing force of the second cushion.

4. The adjusting jig of a button attaching apparatus according to claim 3, the thickness adjuster comprising:

a base member having a shaft capable of being attached to the first holder or the second holder and a flange formed on an end of the shaft; and an additional member formed in a ring capable of being inserted to the shaft and superposed on the flange, wherein the position adjustment thickness, the first adjustment thickness and the second adjustment thickness can be formed only with the flange or the superposition of the flange and the additional member.

5. The adjusting jig of a button attaching apparatus according to claim 4, further comprising a plurality of additional members, wherein any of the additional members is abutted to the first holder or the second holder so that movement thereof is restricted in the direction of the advancement-retraction axis line in order to disable the biasing force of the first cushion or the second cushion, and wherein the other of the additional members does not interfere with the first holder or the second holder for enabling the biasing force of the first cushion or the second cushion.

* * * * *